US006593702B2

(12) United States Patent
Kim et al.

(10) Patent No.: US 6,593,702 B2
(45) Date of Patent: Jul. 15, 2003

(54) PLASMA DISPLAY DEVICE INCLUDING OVERLAPPING ELECTRODES

(75) Inventors: Jae Sung Kim, Kyoungsangbuk-do (KR); Young Kyo Shin, Seoul (KR); Seok Dong Kang, Kyoungsangbuk-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/906,822

(22) Filed: Jul. 18, 2001

(65) Prior Publication Data

US 2002/0047566 A1 Apr. 25, 2002

(30) Foreign Application Priority Data

Jul. 21, 2000 (KR) ..... P2000-42028
Aug. 9, 2000 (KR) ..... P2000-46221
Feb. 1, 2001 (KR) ..... P2001-04743

(51) Int. Cl.[7] ..... G09G 3/10

(52) U.S. Cl. ..... 315/169.1; 315/169.4; 313/584; 313/585; 313/521

(58) Field of Search ..... 315/169.4, 169.1; 313/483, 484, 489, 491, 492, 505, 506, 517, 518, 521, 584, 587, 580, 590; 345/60–63, 66, 68, 74.1

(56) References Cited

U.S. PATENT DOCUMENTS 6,172,461 B1 * 1/2001 Ha ..... 313/585
6,266,033 B1 * 7/2001 Kim ..... 313/492
6,271,810 B1 * 8/2001 Yoo et al. ..... 315/169.4
6,326,727 B1 * 12/2001 Chung ..... 313/586
6,369,781 B2 * 4/2002 Hashimoto et al. ..... 315/169.4
6,414,435 B1 * 7/2002 Akiba ..... 313/584
6,433,477 B1 * 8/2002 Ha et al. ..... 313/586

* cited by examiner

*Primary Examiner*—Haissa Philogene
(74) *Attorney, Agent, or Firm*—Fleshner & Kim, LLP

(57) ABSTRACT

A plasma display panel that is capable of improving a discharge efficiency. In the panel, trigger electrodes are provided at the center of an upper substrate. Sustaining electrodes is provided at the upper substrate and is positioned at a layer different from the trigger electrodes. An address electrode is provided at a lower substrate opposed to the upper substrate in a direction crossing the trigger electrodes.

27 Claims, 10 Drawing Sheets

PLASMA DISPLAY DEVICE INCLUDING OVERLAPPING ELECTRODES

BACKGROUND OF THE INVENTION

1. Field of the Invention

This invention relates to a plasma display panel, and more particularly to a plasma display panel that is capable of improving discharge efficiency.

2. Description of the Related Art

Generally, a plasma display panel (PDP) is a display device utilizing a visible light emitted from a fluorescent layer when an ultraviolet ray generated by a gas discharge excites the fluorescent layer. The PDP has an advantage in that it has a thinner thickness and a lighter weight in comparison to the existent cathode ray tube (CRT) and is capable of realizing a high resolution and a large-scale screen. The PDP includes a plurality of discharge cells arranged in a matrix pattern, each of which makes one pixel of a field.

FIG. 1 is a perspective view showing a discharge cell structure of a conventional three-electrode, alternating current (AC) surface-discharge PDP.

Referring to FIG. 1, a discharge cell of the conventional three-electrode, AC surface-discharge PDP includes a scanning/sustaining electrode 12Y and a common sustaining electrode 12Z provided on an upper substrate 10, and an address electrode 20X provided on a lower substrate 18.

On the upper substrate 10 provided with the scanning/sustaining electrode 12Y and the common sustaining electrode 12Z in parallel, an upper dielectric layer 14 and a protective film 16 are disposed. Wall charges generated upon plasma discharge are accumulated into the upper dielectric layer 14. The protective film 16 prevents a damage of the upper dielectric layer 14 caused by a sputtering during the plasma discharge and improves the emission efficiency of secondary electrons. This protective film 16 is usually made from magnesium oxide (MgO).

A lower dielectric layer 22, barrier ribs 24 are formed on the lower substrate 18 provided with the address electrode 20X. The surfaces of the lower dielectric layer 22 and the barrier ribs 24 are coated with a fluorescent layer 26. The address electrode 20X is formed in a direction crossing the scanning/sustaining electrode 12Y and the common sustaining electrode 12Z.

The barrier rib 24 is formed in parallel to the address electrode 20X to prevent an ultraviolet ray and a visible light generated by a discharge from being leaked to the adjacent discharge cells. The fluorescent layer 26 is excited by an ultraviolet ray generated during the plasma discharge to generate any one of red, green and blue visible light rays. An inactive gas for a gas discharge is injected into a discharge space defined between the upper and lower substrate 10 and 18 and the barrier rib 24.

Such a three-electrode AC surface-discharge PDP drives one frame, which is divided into various sub-fields having a different discharge number, so as to realize gray levels of a picture. Each sub-field is again divided into a reset period for uniformly causing a discharge, an address period for selecting the discharge cell and a sustaining period for realizing the gray levels depending on the discharge number.

For instance, when it is intended to display a picture of 256 gray levels, a frame interval equal to 1/60 second (i.e. 16.67 msec) is divided into 8 sub-fields. Each of the 8 sub-fields is again divided into a reset period, an address period and a sustaining period. The reset period and the address period of each sub-field are equal every sub-field, whereas the sustaining period thereof is increased at a ration of $2^n$ (wherein n=0, 1, 2, 3, 4, 5, 6 and 7) at each sub-field. Since the sustaining period becomes different at each sub-field as mentioned above, the gray levels of a picture can be expressed.

In the reset period, a reset pulse is applied to the scanning/sustaining electrode 12Y to cause a reset discharge. In the address period, a scanning pulse is applied to the scanning/sustaining electrode 12Y and a data pulse is applied to the address electrode 20X, to thereby cause an address discharge between two electrodes 12Y and 20X. During the address discharge, wall charges are formed on the upper and lower dielectric layers 14 and 22. In the sustaining period, a sustaining discharge is caused between two electrodes 12Y and 12Z by an alternating current signal alternately applied to the scanning/sustaining electrode 12Y and the common sustaining electrode 12Z.

However, the conventional AC surface-discharge PDP has a sustaining discharge space concentrated at the center of the upper substrate 10 to reduce a utility of the discharge space. Thus, it has a problem that the reduced discharge area deteriorate a light emission efficiency.

In order to solve this problem, there has been suggested a five-electrode, AC surface-discharge PDP as shown in FIG. 2.

Referring to FIG. 2, the conventional five-electrode, AC surface-discharge PDP includes first and second trigger electrodes 34Y and 34Z provided on an upper substrate 30 in such a manner to be positioned at the center of a discharge cell, first and second sustaining electrodes 32Y and 32Z provided on the upper substrate 30 in such a manner to be positioned at the edge of the discharge cell, and an address electrode 42X provided at a lower substrate in a direction crossing the trigger electrodes 34Y and 34Z and the first and second sustaining electrodes 32Y and 32Z.

On the upper substrate 30 provided with the first sustaining electrode 32Y, the first trigger electrode 34Y, the second trigger electrode 34Z and the second sustaining electrode 32Z in parallel, an upper dielectric layer 36 and a protective layer 38 are disposed. On the other hand, a lower dielectric layer 44 and a barrier rib 46 are formed on a lower substrate 40 provided with the address electrode 42X, and a fluorescent layer 48 is coated on the surfaces of the lower dielectric layer 44 and the barrier ribs 46.

The trigger electrodes 34Y and 34Z spaced at a narrow distance Ni at the center of the discharge cell are supplied with a sustaining pulse in the sustaining period to initiate a sustaining discharge. The first and second sustaining electrodes 32Y and 32Z spaced at a wide distance Wi at the edge of the discharge cell maintain a plasma discharge after the discharge between the trigger electrodes 34Y and 34Z was initiated by an application of a sustaining pulse in the sustaining period.

FIG. 3 is a section view representing a state of rotating the upper substrate by 90° with respect to the lower substrate so as to show up the overall electrode structure within one discharge cell.

An operation process of the five-electrode AC surface-discharge PDP will be described in detail with reference to FIG. 3 and FIG. 4 below.

The five-electrode AC surface-discharge PDP drives one frame, which is divided into various sub-fields having a different discharge number, so as to realize gray levels of a picture. Each sub-field is again divided into a reset period for uniformly causing a discharge, an address period for selecting the discharge cell and a sustaining period for expressing the gray levels depending on the discharge number.

First, in the reset period, a reset pulse is applied to the second trigger electrode Tz of the discharge cell to generate a reset discharge for initializing the discharge cell. At this time, the address electrode X is supplied with a direct current voltage for preventing an erroneous discharge.

In the address period, a scanning pulse C is sequentially applied to the first trigger electrode Ty and a data pulse Va synchronized with the scanning pulse C is applied to the address electrode X. At this time, an address discharge is generated at the discharge cells supplied with the data pulse Va.

In the sustaining period, a sustaining pulse is alternately applied to the first trigger electrode Ty and a first sustaining electrode Sy and the second trigger electrode Tz and a second sustaining electrode Sz. In this case, a voltage Vt applied to the trigger electrodes Ty and Tz has a lower level than a voltage Vs applied to the first and second sustaining electrodes Sy and Sz.

When such a sustaining pulse is applied, a primary discharge is caused between the first and second trigger electrodes Ty and Tz. In other words, a primary discharge is generated between the first and second trigger electrodes Ty and Tz, and a secondary discharge is induced between the first and second sustaining electrodes Sy and Sz with the aid of a priming effect of charged particles generated by the primary discharge.

The sustaining pulse applied to the sustaining period may be alternately applied between the first trigger electrode Ty and the second sustaining electrode Sz and the second trigger electrode Tz and the first sustaining electrode Sy as shown in FIG. 5. If the primary discharge is generated between the trigger electrodes Ty and Tz as mentioned above, then a sustaining discharge can be generated due to a priming discharge between the trigger electrodes Ty and Tz even though a distance Wi between the first sustaining electrode Sy and the second sustaining electrode Sz is large. In other words, electrons emitted from the first and second sustaining electrodes Sy and Sz have a long path. If electrons have a long path, then a quantity of ultraviolet rays generated by a collision of electrons with an inactive gas is increased, and thus the increased ultraviolet rays excite a fluorescent material 48 to create a lot of visible lights from the fluorescent material 48.

However, the scanning pulse C is applied only to the first trigger electrode Ty in the address period in the conventional five-electrode PDP. Thus, wall charges produced by the address discharge are formed only at the first trigger electrode Ty. In other words, since wall charges are formed only at the first trigger electrode Ty, the sustaining discharge occurring between the first and second sustaining electrodes Sy and Sz fails to utilize the wall charges produced in the address period.

Accordingly, in order to cause an effective sustaining discharge, a sustaining pulse having a high voltage level should be applied to the first and second sustaining electrodes Sy and Sz. However, if a sustaining pulse having a high voltage level is applied to the first and second sustaining electrodes Sy and Sz, then an erroneous discharge occurs with respect to the address electrode X.

In the mean time, the primary discharge between the trigger electrodes Ty and Tz for initiating a sustaining discharge should be a minute discharge. However, a strong discharge occurs between the trigger electrodes Ty and Tz spaced at a narrow distance Ni. If a strong discharge is generated between the trigger electrodes Ty and Tz, then a sustaining discharge between the first sustaining electrode Sy and the second sustaining electrode Sz occurs weakly.

If a weak discharge occurs between the first and second sustaining electrodes Sy and Sz, then a quantity of ultraviolet rays exciting the fluorescent material is reduced to deteriorate discharge efficiency. Furthermore, wall charges formed by the primary discharge between the trigger electrodes Ty and Tz get lost due to the sustaining discharge of the first and second sustaining electrodes Sy and Sz. If wall charges formed at the rear sides of the trigger electrodes Ty and Tz get lost, then a high voltage should be applied so as to cause a primary discharge between the trigger electrodes Ty and Tz.

SUMMARY OF THE INVENTION

Accordingly, it is an object of the present invention to provide a plasma display panel that is adaptive for improving discharge efficiency.

In order to achieve these and other objects of the invention, a plasma display panel according to an embodiment of the present invention includes trigger electrodes provided at the center of an upper substrate; sustaining electrodes provided at the upper substrate and positioned at a layer different from the trigger electrodes; and an address electrode provided at a lower substrate opposed to the upper substrate in a direction crossing the trigger electrodes.

In the plasma display panel, the trigger electrodes overlap with the sustaining electrode pair by a desired portion.

The plasma display panel further includes a first dielectric layer formed between the trigger electrodes and the sustaining electrode pair in such a manner to cover the trigger electrodes; a second dielectric layer covering the sustaining electrode pair and the first dielectric layer; and a protective film covering the second dielectric layer.

The plasma display panel further includes a floating electrode provided between the trigger electrodes.

A plasma display panel according to another embodiment of the present invention includes first and second sustaining electrodes provided at an upper substrate; first and second trigger electrodes provided between the first and second sustaining electrodes; a dielectric layer covering the first and second sustaining electrodes and the first and second trigger electrodes; and at least one shielding wall protruded from the dielectric layer.

In the plasma display panel, said shielding wall consists of two shielding walls protruded from the dielectric layer. Herein, said two shielding walls consist of a first shielding wall positioned between the first sustaining electrode and the first trigger electrode, and a second shielding wall positioned between the second sustaining electrode and the second trigger electrode.

In the plasma display panel, the shielding wall is protruded by more than 10 $\mu$m from the dielectric layer. The shielding wall is made from the same material as the dielectric layer.

The plasma display panel further includes a protective film covering the dielectric layer and the shielding wall.

The plasma display panel further includes a floating electrode provided between the first and second trigger electrodes.

A plasma display panel according to still another embodiment of the present invention first and second sustaining electrodes provided at an upper substrate; first and second trigger electrodes provided between the first and second sustaining electrodes; and a floating electrode provided between the first and second trigger electrodes.

In the plasma display panel, the floating electrode has a width smaller than the first and second trigger electrodes. The floating electrode has preferably a width less than ⅔ of the widths of the first and second trigger electrodes.

In the plasma display panel, a voltage induced to the floating electrode is determined depending on voltages applied to the first and second trigger electrodes.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 1:
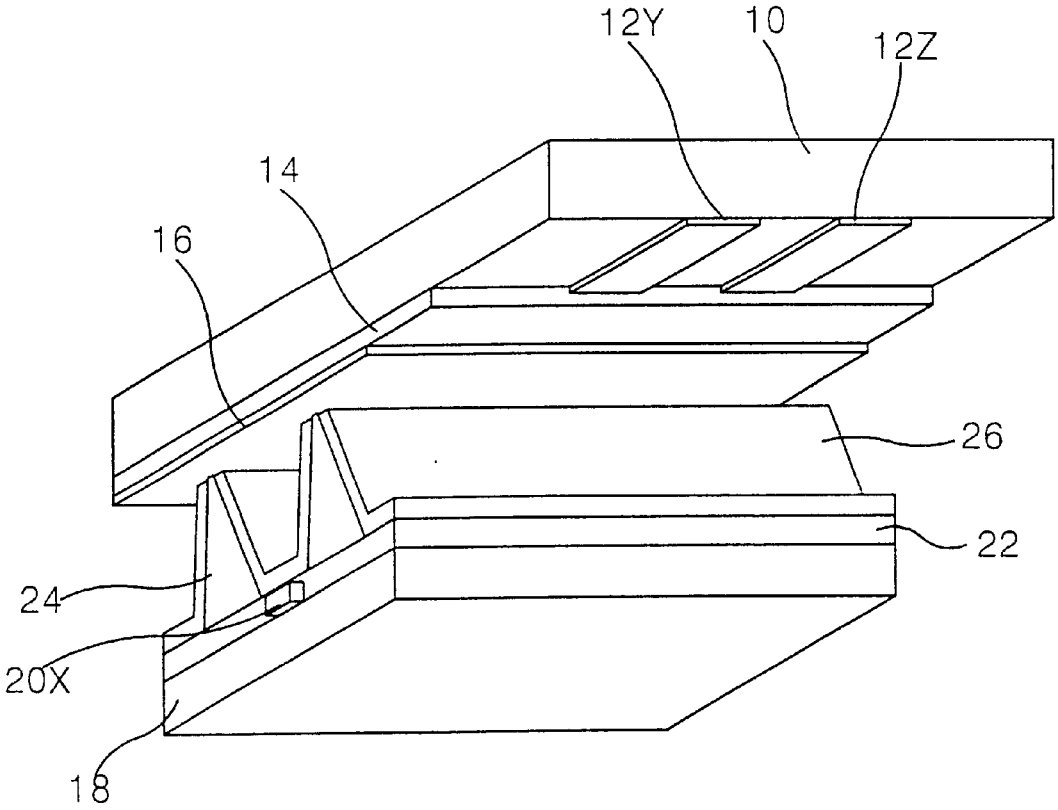
FIG. 1 CONVENTIONAL ART
FIG. 1 is a perspective view showing a discharge cell structure of a conventional three-electrode AC surface-discharge plasma display panel.
Figure 2:
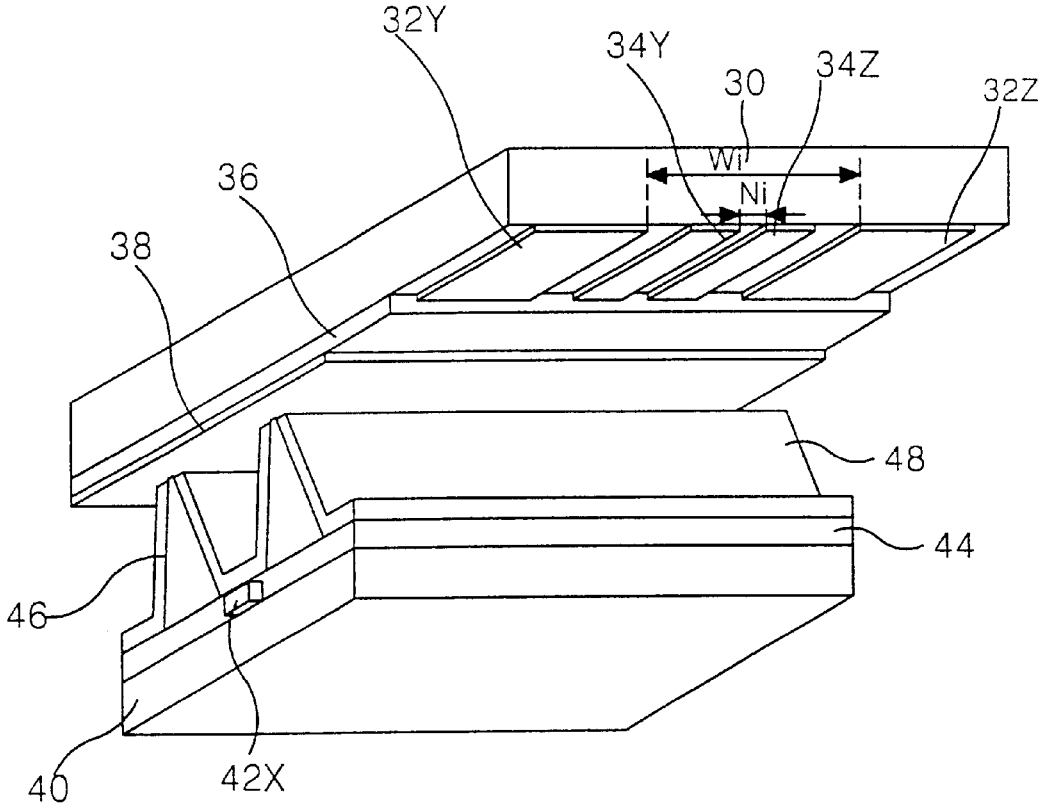
FIG. 2 CONVENTIONAL ART
FIG. 2 is a perspective view showing a discharge cell structure of a conventional five-electrode, AC surface-discharge plasma display panel.
Figure 3:
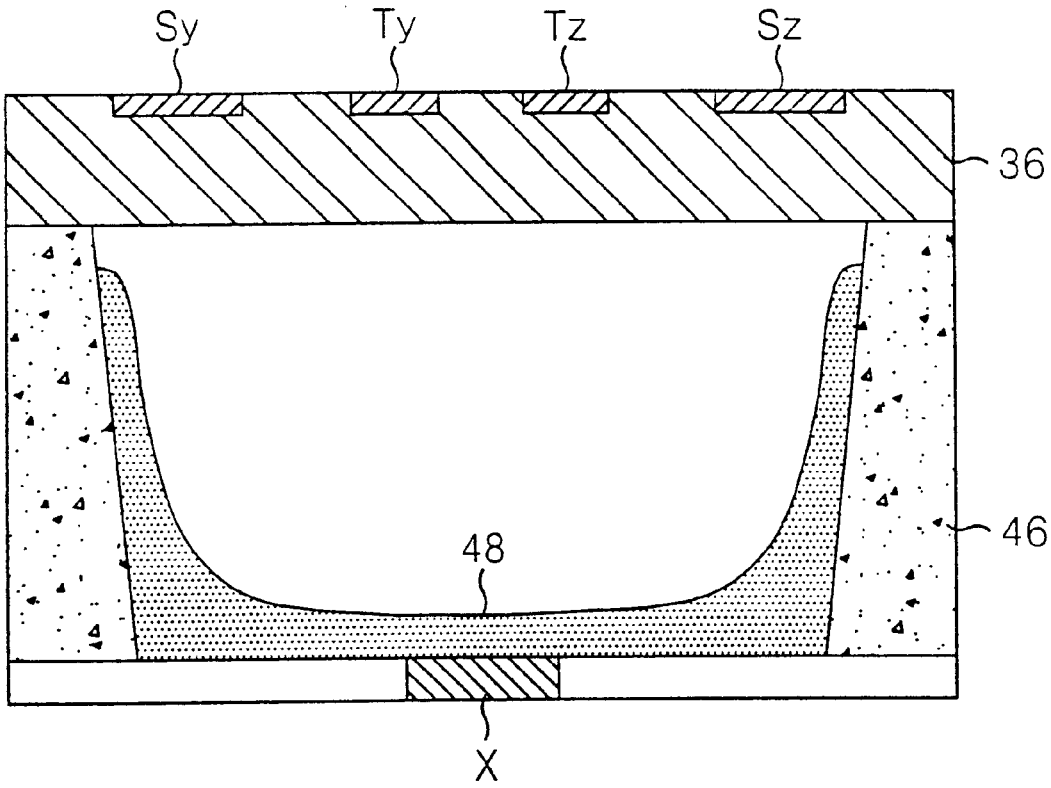
FIG.3 CONVENTIONAL ART
FIG. 3 is a section view showing a discharge cell structure of the five-electrode AC surface-discharge plasma display panel shown in FIG. 2.
Figure 4:
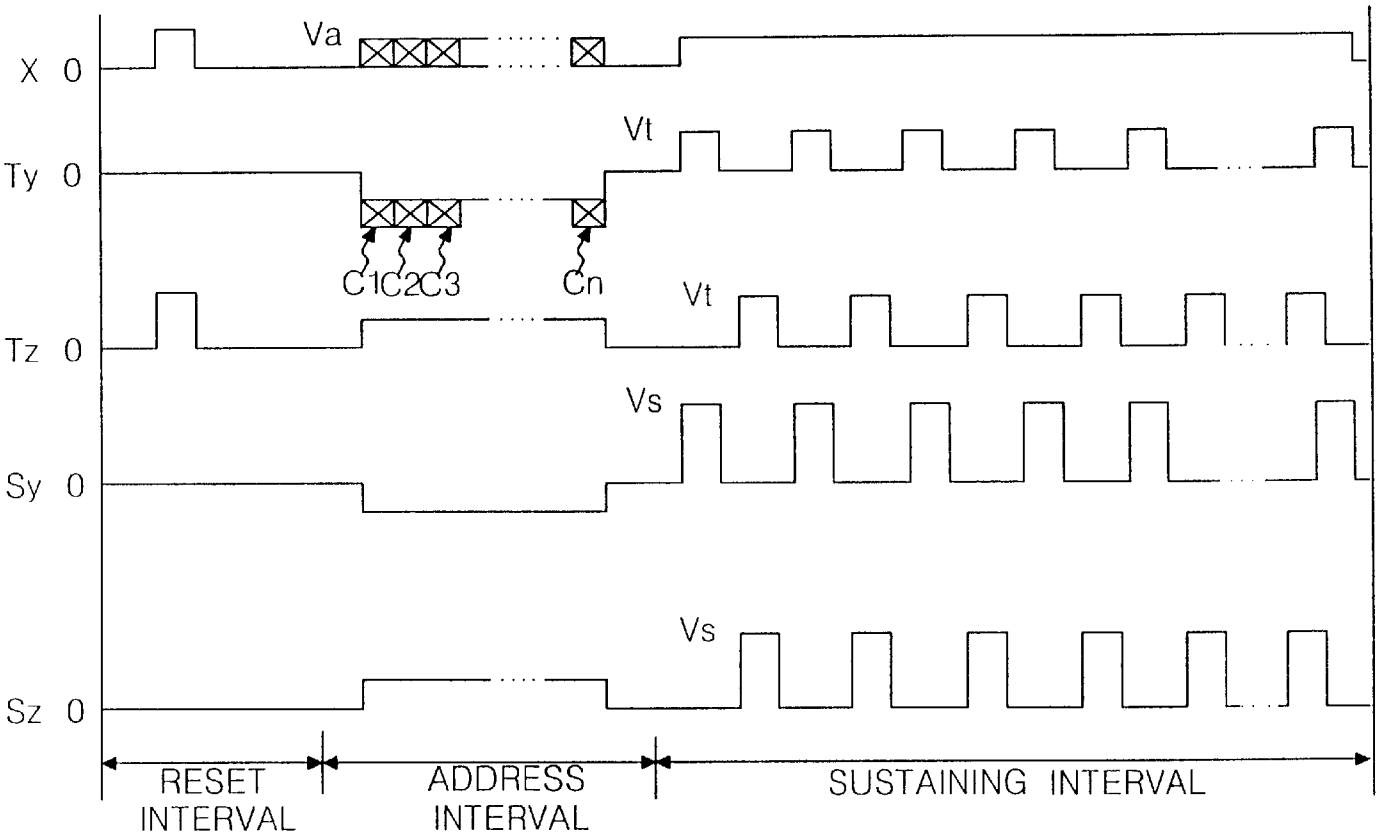
FIG. 4 CONVENTIONAL ART
FIG. 4 and FIG. 5 are waveform diagrams of driving signals applied to the plasma display panel shown in FIG. 2.
Figure 5:
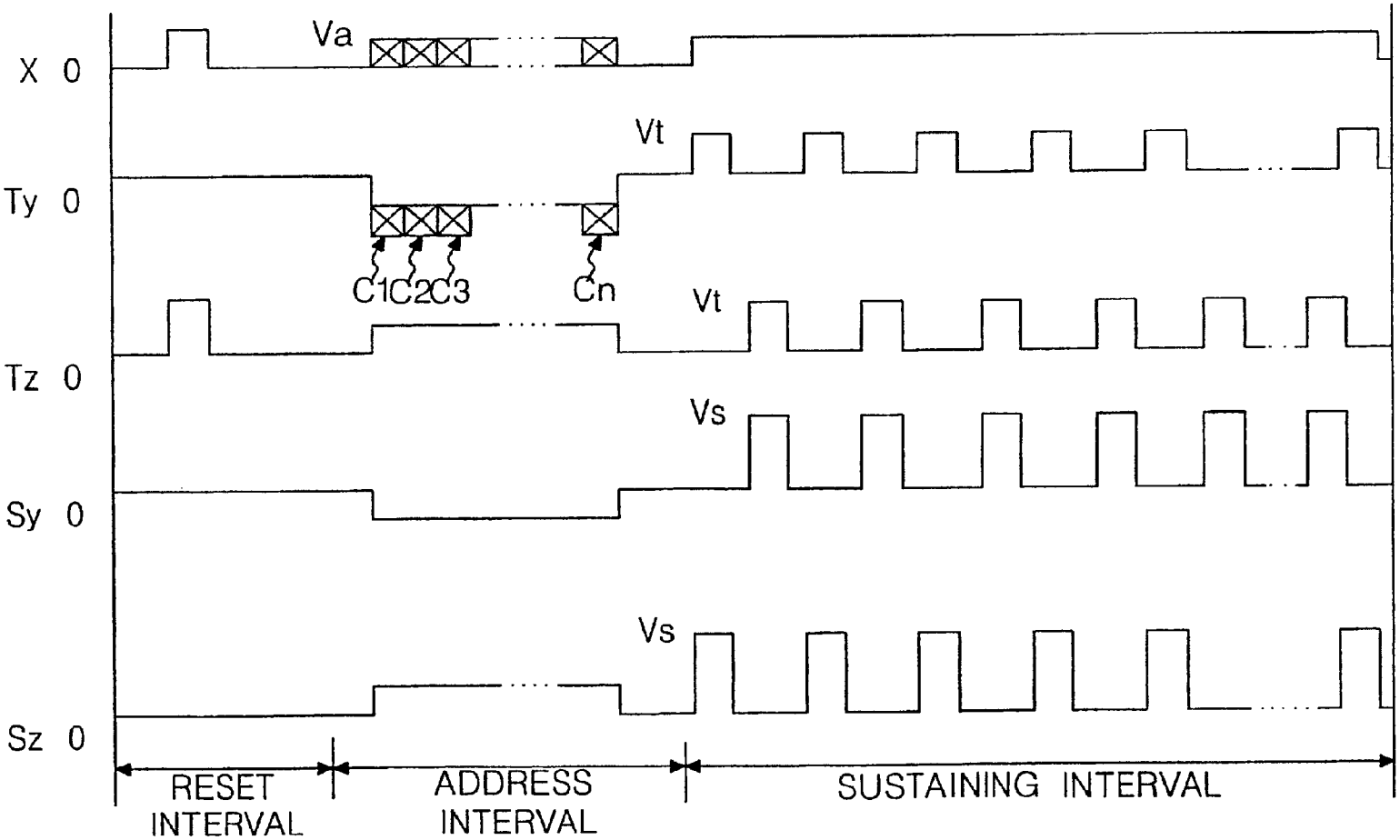
FIG. 5 CONVENTIONAL ART
Figure 6:
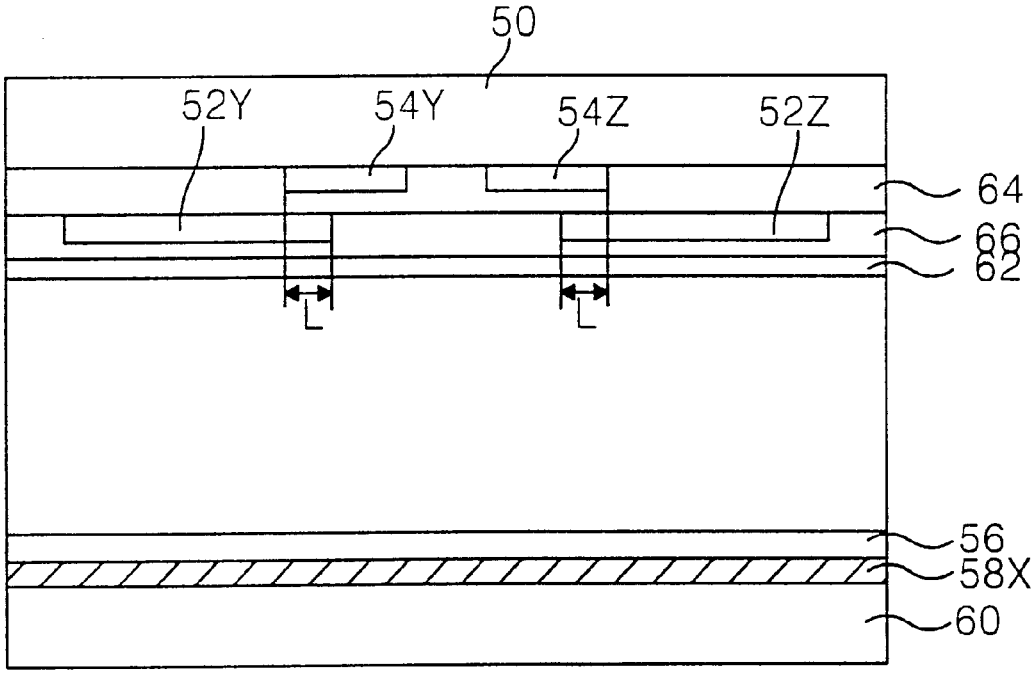
FIG. 6 is a section view showing a structure of a plasma display panel according to a first embodiment of the present invention.

Referring to FIG. 6, there is shown a plasma display panel (PDP) according to a first embodiment of the present invention.

The PDP according to the first embodiment includes first and second trigger electrodes 54Y and 54Z provided on an upper substrate 50 in such a manner to be positioned at the center of a discharge cell, first and second sustaining electrodes 52Y and 52Z provided on the upper substrate 50 in such a manner to be positioned at the edge of the discharge cell, and an address electrode 58X provided at the center of a lower substrate 60 in a direction perpendicular to the trigger electrodes 54Y and 54Z and the sustaining electrodes 52Y and 52Z.

The first and second trigger electrodes 54Y and 54Z and the first and second sustaining electrodes 52Y and 52Z are provided at different layers in such a manner to overlap with each other by a desired portion L. A first upper dielectric layer 64 is formed on the first and second trigger electrodes 54Y and 54Z, and the first and second sustaining electrodes 52Y and 52Z are formed on the first upper dielectric layer 64. On the first and second sustaining electrodes 52Y and 52Z, a second upper dielectric layer 66 and a protective film 62 are disposed.

A lower dielectric layer 56 and barrier ribs (not shown) are formed on the lower substrate 60 provided with the address electrode 58X. The surfaces of the lower dielectric layer 56 and the barrier ribs are coated with a fluorescent material layer (not shown).

Such a PDP according to the first embodiment drives one frame, which is divided into various sub-fields having a different discharge number, so as to express gray levels of a picture. Each sub-field is again divided into a reset period for uniformly causing a discharge, an address period for selecting the discharge cell and a sustaining period for expressing the gray levels depending on the discharge number.

In the reset period, a reset pulse is applied to the first trigger electrode 54Y of the discharge cell to cause a reset discharge for initializing the discharge cell.

In the address period, a scanning pulse is sequentially applied to the first trigger electrode 54Y and a data pulse synchronized with the scanning pulse is applied to the address electrode 58X. An address discharge is generated at the discharge cell supplied with the data pulse, and wall charges created upon address discharge are formed on the first trigger electrode 54Y. At this time, since the first trigger electrode 54Y overlaps with the first sustaining electrode 52Y, wall charges created upon address discharge also are formed at a portion L where the first sustaining electrode 52Y overlaps with the first trigger electrode 54Y.

In the sustaining period, a sustaining pulse having a desired voltage level is alternately applied to the first and second sustaining electrodes 52Y and 52Z, and a trigger pulse having a lower voltage level than the sustaining pulse is alternately applied to the first and second trigger electrodes 54Y and 54Z. When the sustaining pulse and the trigger pulse are applied to the first and second sustaining electrodes 52Y and 52Z and the first and second trigger electrodes 54Y and 54Z, respectively, a trigger discharge is generated between the first and second trigger electrodes 54Y and 54Z.

If the trigger discharge occurs, then charged particles are created. A secondary discharge is induced between the first and second sustaining electrodes 52Y and 52Z due to a priming effect of the charged particles. At this time, wall charges are formed at said overlapping portion between the first sustaining electrode 52Y and the first trigger electrode 54Y, so that it becomes possible to supply a sustaining pulse having a low voltage level.

More specifically, a sustaining pulse having a voltage level as low as the wall charges can be applied to the first and second sustaining electrodes 52Y and 52Z. Further, since the first sustaining electrode 52Y overlaps with the first trigger electrode 54Y and the second sustaining electrode 52Z overlaps with the second trigger electrode 54Z, a voltage value of the trigger pulse becomes overlapped with that of the sustaining pulse. Accordingly, the PDP according to the first embodiment of the present invention can supply a sustaining pulse having a low voltage level, thereby improving discharge efficiency.

Figure 7:
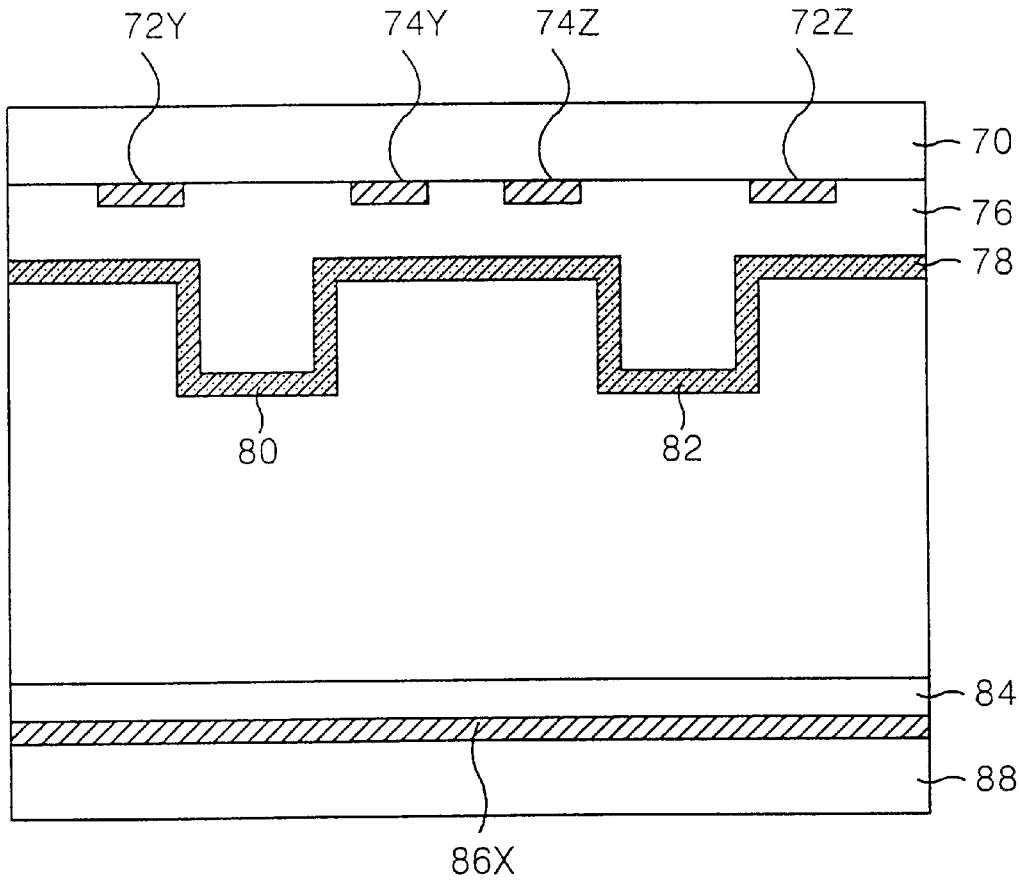
FIG. 7 and FIG. 8 are section views showing a structure of a plasma display panel according to a second embodiment of the present invention.
Figure 8:
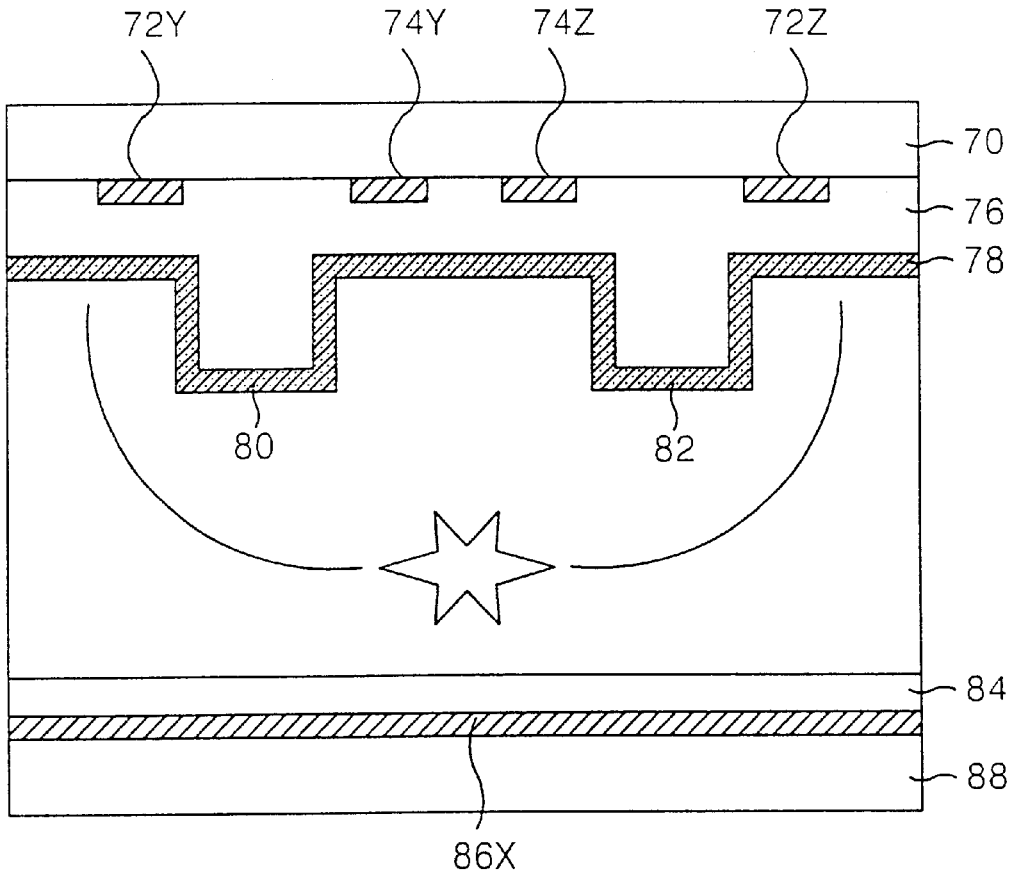

Referring to FIG. 7 and FIG. 8, there is shown a plasma display panel (PDP) according to a second embodiment of the present invention.

The PDP according to the second embodiment includes first and second trigger electrodes 74Y and 74Z provided on an upper substrate 70 in such a manner to be positioned at the center of a discharge cell, first and second sustaining electrodes 72Y and 72Z provided on the upper substrate 70 in such a manner to be positioned at the edge of the discharge cell, and an address electrode 86X provided at the center of a lower substrate 88 in a direction perpendicular to the trigger electrodes 74Y and 74Z and the sustaining electrodes 72Y and 72Z.

On the upper substrate 70 on which the first sustaining electrode 72Y, the first trigger electrode 74Y, the second trigger electrode 74Z and the second sustaining electrode 72Z are arranged in parallel to each other, an upper dielectric layer 76 and a protective film 78 are disposed.

The upper dielectric layer 76 provided between the first sustaining electrode 72Y and the first trigger electrode 74Y is protruded by a desired height to define a first shielding wall 80. The upper dielectric layer 76 provided between the second sustaining electrode 72Z and the second trigger electrode 74Z is protruded by a desired height to define a second shielding wall 82. The first and second shielding walls 80 and 82 are protruded by a height more than 10 $\mu$m from the dielectric layer 76.

A lower dielectric layer 84 and barrier ribs (not shown) are formed on the lower substrate 88 provided with the address electrode 86X. The surfaces of the lower dielectric layer 84 and the barrier ribs are coated with a fluorescent material layer (not shown).

Such a PDP according to the second embodiment drives one frame, which is divided into various sub-fields having a different discharge number, so as to express gray levels of a picture. Each sub-field is again divided into a reset period for uniformly causing a discharge, an address period for selecting the discharge cell and a sustaining period for expressing the gray levels depending on the discharge number.

In the reset period, a reset pulse is applied to the second trigger electrode 74Z of the discharge cell to cause a reset discharge for initializing the discharge cell. At this time, the address electrode 86X is supplied with a direct current voltage for preventing an erroneous discharge.

In the address period, a scanning pulse is sequentially applied to the first trigger electrode 74Y and a data pulse synchronized with the scanning pulse is applied to the address electrode 86X. In the sustaining period, a sustaining pulse is alternately applied between the first trigger electrode 74Y and the first sustaining electrode 72Y and the second trigger electrode 74Z and the second sustaining electrode 72Z.

If such a sustaining pulse is applied, then a discharge is initiated between the first and second trigger electrodes 74Y and 74Z. When a discharge occurs between the first and second trigger electrodes 74Y and 74Z, wall charge and charged particles are created and supplied within the discharge cells. In this case, the wall charges produced by the discharge between the first and second trigger electrodes 74Y and 74Z are formed at the rear sides of the first and second trigger electrodes 74Y and 74Z, that is, between the first and second shielding walls 80 and 82. The charged particles produced by the discharge between the first and second trigger electrodes 74Y and 74Z are supplied to the first and second sustaining electrodes 72Y and 72Z. After the discharge was initiated between the first and second trigger electrodes 74Y and 74Z, a secondary discharge between the first and second sustaining electrodes 72Y and 72Z is induced.

In this case, since the wall charges formed at the rear sides of the first and second trigger electrodes 74Y and 74Z are protected by the first and second shielding walls 80 and 82, they are not lost due to the secondary discharge between the first and second sustaining electrodes 72Y and 72Z. Thus, a low voltage can be applied during the next discharge of the first and second trigger electrodes 74Y and 74Z. Electrons emitted by the secondary discharge between the first and second sustaining electrodes 72Y and 72Z has a long path as shown in FIG. 8 with the aid of the first and second shielding walls 80 and 82.

If electrons have a long path, then a quantity of ultraviolet rays generated by a collision of electrons with an inactive gas is increased. The increased ultraviolet rays excite a fluorescent layer to create a lot of visible lights from the fluorescent layer. In other words, the PDP according to the second embodiment of the present invention can provide a long-path discharge and apply a sustaining pulse having a low voltage level to the first and second trigger electrodes 74Y and 74Z, thereby improving a discharge efficiency.

Figure 9:
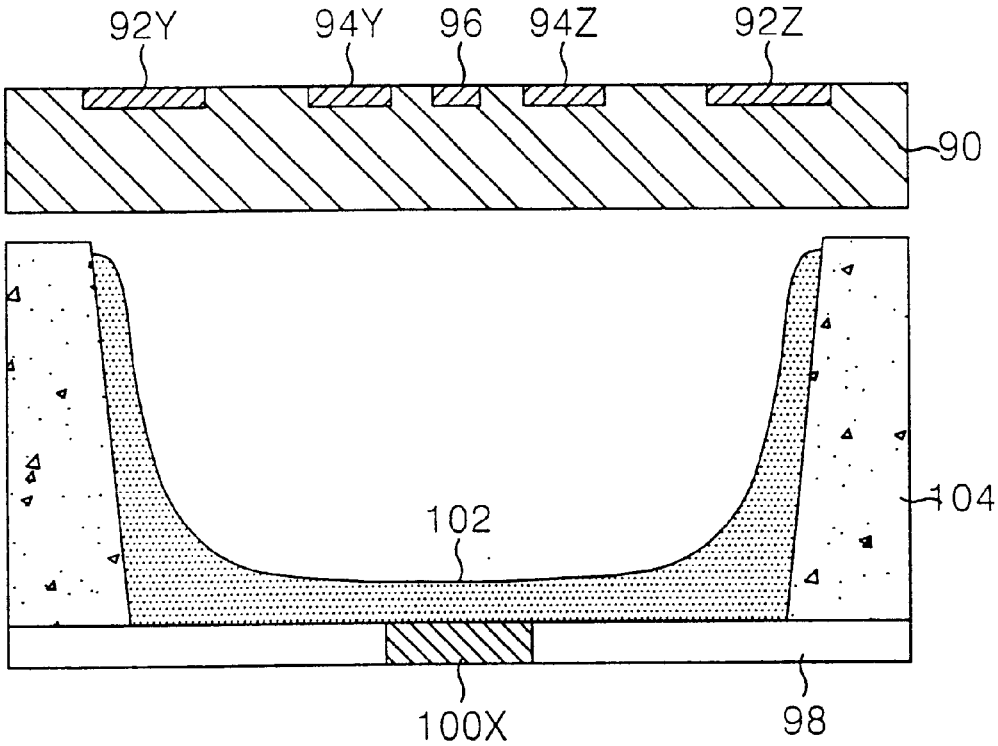
FIG. 9 is a section view showing a structure of a plasma display panel according to a third embodiment of the present invention.

FIG. 9 is a section view showing a structure of a plasma display panel according to a third embodiment of the present invention. In FIG. 9, the upper substrate is rotated by 90° with respect to the lower substrate so as to show up the overall electrode structure within one discharge cell.

Referring to FIG. 9, the PDP according to the third embodiment includes first and second trigger electrodes 94Y and 94Z provided on an upper dielectric layer 90 in such a manner to be positioned at the center of a discharge cell, first and second sustaining electrodes 92Y and 92Z provided on the upper dielectric layer 90 in such a manner to be positioned at the edge of the discharge cell, a floating electrode 96 provided between the first and second trigger electrodes 94Y and 94Z, an address electrode 100X provided on a lower dielectric layer 98, barrier ribs 104 formed into a desired height between the upper dielectric layer 90 and the lower dielectric layer 98, and a fluorescent material layer 102 coated on the surfaces of the lower dielectric layer 98 and the barrier ribs 104.

The floating electrode 96 provided between the first and second trigger electrodes 94Y and 94Z has a width smaller than ⅔ of the widths of the trigger electrodes 94Y and 94Z. In other words, the floating electrode 96 has a smaller width than the trigger electrodes 94Y and 94Z to thereby prevent a distance between the trigger electrodes 94Y and 94Z from being enlarged. Such a floating electrode 96 plays a role to reduce an intensity of the discharge between the first and second trigger electrodes 94Y and 94Z.

More specifically, a sustaining pulse is alternately applied to the trigger electrodes 94Y and 94Z in the sustaining period. Since the sustaining pulse is alternately applied, the second trigger electrode 94Z maintains a ground potential when the sustaining pulse is being applied to the first trigger electrode 94Y. Likewise, the first trigger electrode 94Y maintains a ground potential when the sustaining pulse is being applied to the second trigger electrode 94Z.

Figure 10:
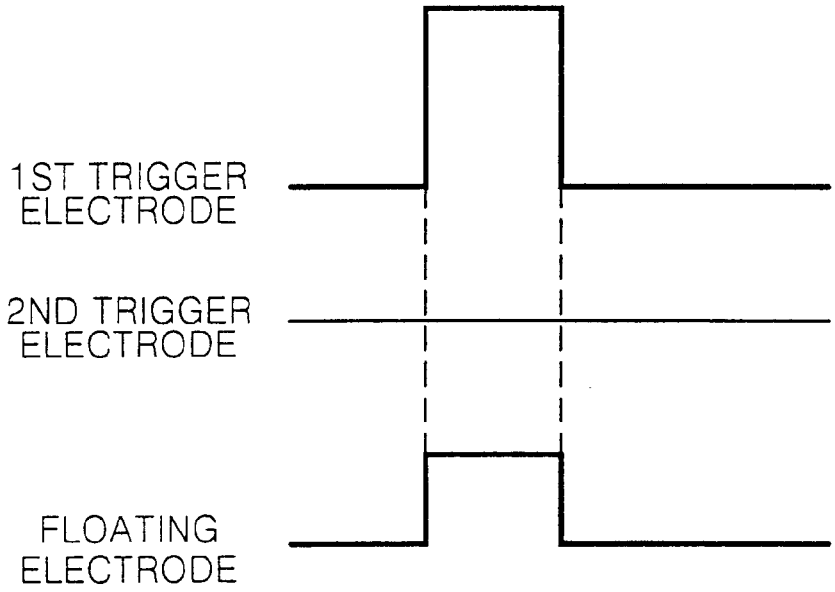
FIG. 10 illustrates a voltage induced to the floating electrode shown in FIG. 9.

At this time, a voltage having an intermediate value of the voltages at the first and second trigger electrodes 94Y and 94Z is induced to the floating electrode 96 positioned between the first and second trigger electrodes 94Y and 94Z. In other words, a voltage level of the floating electrode 96 is determined depending on the voltages applied to the first and second trigger electrodes 94Y and 94Z. For instance, if a sustaining pulse is applied to the first trigger electrode 94Y and the second trigger electrode 94Z remains at a ground potential, then a voltage having an intermediate value of the voltages at the first and second trigger electrodes 94Y and 94Z is induced to the floating electrode 96 as shown in FIG. 10.

Figure 11:
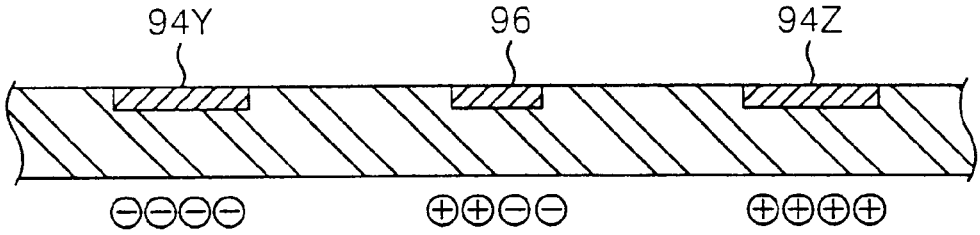
FIG. 11 illustrates wall charges formed at the floating electrode shown in FIG. 9.

At this time, the first trigger electrode 94Y has a voltage level higher than the floating electrode 96. Thus, negative(−)

wall charges are formed at the first trigger electrode 94Y as shown in FIG. 11. Further, positive(+) wall charges are formed at one side of the floating electrode 96 positioned adjacently to the first trigger electrode 94Y. On the other hand, the second trigger electrode 94Z has a voltage level lower than the floating electrode 96. Thus, positive(+) wall charges are formed at the second trigger electrode 94Z. Further, negative(−) wall charges are formed at one side of the floating electrode 96 positioned adjacently to the second trigger electrode 94Z.

In other words, wall charges induced to the floating electrode 96 are formed in a direction of reducing an intensity of the discharge between the trigger electrodes 94Y and 94Z. Thus, a weak discharge is generated between the first and second trigger electrodes 94Y and 94Z while a strong discharge is generated between the first and second sustaining electrodes 92Y and 92Z.

Accordingly, a large amount of ultraviolet rays created by the strong discharge between the first and second sustaining electrodes 92Y and 92Z excite the fluorescent layer much more than when discharge generated between the first and second trigger electrodes 94Y and 94Z is strong. At this time, a lot of visible lights are generated from the fluorescent layer to improve discharge efficiency. The third embodiment of the present invention may have the same application as the first and second embodiments.

As described above, according to the present invention, the sustaining electrodes and the trigger electrodes are formed in such a manner to overlap with each other by a desired portion, thereby utilizing wall charges created by the address discharge for the sustaining discharge. Accordingly, a sustaining pulse having a low voltage level can be supplied to improve discharge efficiency.

Furthermore, according to the present invention, the shielding walls are provided between the trigger electrodes and the sustaining electrodes to prevent a loss of wall charges formed at the rear sides of the trigger electrodes. Accordingly, a sustaining pulse having a voltage level as low as a voltage of the wall charges can be applied to the trigger electrodes.

In addition, the floating electrode is provided between the trigger electrodes to minimize an intensity of the discharge generated between the trigger electrodes. Accordingly, it becomes possible to cause a strong discharge between the sustaining electrodes.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A plasma display panel, comprising:

trigger electrodes provided at the center of an upper substrate;

sustaining electrodes provided at the upper substrate and positioned in a layer different from the trigger electrodes; and an address electrode provided at a lower substrate opposed to the upper substrate in a direction crossing the trigger electrodes.

2. The plasma display panel as claimed in claim 1, wherein the trigger electrodes overlap with the sustaining electrode pair by a desired portion.

3. The plasma display panel as claimed in claim 1, further comprising:

a first dielectric layer formed between the trigger electrodes and the sustaining electrode pair in such a manner to cover the trigger electrodes;

a second dielectric layer covering the sustaining electrode pair and the first dielectric layer; and a protective film covering the second dielectric layer.

4. The plasma display panel as claimed in claim 1, further comprising:

a floating electrode provided between the trigger electrodes.

5. A plasma display panel, comprising:

first and second sustaining electrodes provided at an upper substrate;

first and second trigger electrodes provided between the first and second sustaining electrodes;

a dielectric layer covering the first and second sustaining electrodes and the first and second trigger electrodes; and at least one shielding wall protruded from the dielectric layer.

6. The plasma display panel as claimed in claim 5, wherein said shielding wall consists of two shielding walls protruded from the dielectric layer.

7. The plasma display panel as claimed in claim 6, wherein said two shielding walls consist of a first shielding wall positioned between the first sustaining electrode and the first trigger electrode, and a second shielding wall positioned between the second sustaining electrode and the second trigger electrode.

8. The plasma display panel as claimed in claim 5, wherein the shielding wall is protruded by more than 10 $\mu$m from the dielectric layer.

9. The plasma display panel as claimed in claim 5, wherein the shielding wall is made from the same material as the dielectric layer.

10. The plasma display panel as claimed in claim 5, further comprising:

a protective film covering the dielectric layer and the shielding wall.

11. The plasma display panel as claimed in claim 5, further comprising:

a floating electrode provided between the first and second trigger electrodes.

12. A plasma display panel, comprising:

first and second sustaining electrodes provided at an upper substrate;

first and second trigger electrodes provided between the first and second sustaining electrodes; and a floating electrode provided between the first and second trigger electrodes.

13. The plasma display panel as claimed in claim 12, wherein the floating electrode has a width smaller than the first and second trigger electrodes.

14. The plasma display panel as claimed in claim 13, wherein the floating electrode has a width less than ⅔ of the widths of the first and second trigger electrodes.

15. The plasma display panel as claimed in claim 12, wherein a voltage induced to the floating electrode is determined depending on voltages applied to the first and second trigger electrodes.

16. An apparatus comprising:

at least one first set of electrodes; and at least one second set of electrodes, wherein the second set of electrodes at least partially overlap the first set of electrodes, wherein the first set of electrodes are trigger electrodes.

17. The apparatus of claim 16, wherein the apparatus is a plasma display panel.

18. The apparatus of claim 16, wherein:

the at least one first set of electrodes comprises two electrodes; and the at least one second set of electrodes comprises two electrodes.

19. The apparatus of claim 16, wherein the second set of electrodes are sustaining electrodes.

20. The apparatus of claim 16, wherein the first set of electrodes and the second set of electrodes are on different planes.

21. The apparatus of claim 16, comprising:

at least one barrier;

at least one flourescent layer; and at least one address electrode.

22. An apparatus comprising:

at least one first set of electrodes; and at least one second set of electrodes, wherein the second set of electrodes is on a different plane than the first set of electrodes, wherein the first set of electrodes are trigger electrodes.

23. The apparatus of claim 22, wherein:

the at least one first set of electrodes comprises two electrodes; and the at least one second set of electrodes comprises two electrodes.

24. The apparatus of claim 23, wherein the apparatus is a plasma display panel.

25. The apparatus of claim 22, comprising:

at least one barrier;

at least one flourescent layer; and at least one address electrode.

26. The apparatus of claim 23, wherein the second set of electrodes are sustaining electrodes.

27. The apparatus of claim 23, wherein the first set of electrodes at least partially overlaps the second set of electrodes.

* * * * *